United States Patent [19]

Morishima

[11] Patent Number: 4,574,391

[45] Date of Patent: Mar. 4, 1986

[54] STEREOPHONIC SOUND PRODUCING APPARATUS FOR A GAME MACHINE

[75] Inventor: Masaharu Morishima, Nara, Japan

[73] Assignee: Funai Electric Company Limited, Osaka, Japan

[21] Appl. No.: 545,855

[22] Filed: Oct. 27, 1983

[30] Foreign Application Priority Data

Aug. 22, 1983 [JP] Japan ..... 58-154325

[51] Int. Cl.[4] ..... H04R 5/00

[52] U.S. Cl. ..... 381/18; 381/24; 273/85 G

[58] Field of Search ..... 381/17, 18, 19, 20, 381/21, 22, 1, 24, 119, 104; 273/85 G

[56] References Cited

U.S. PATENT DOCUMENTS 3,761,631 9/1973 Ito et al. ..... 381/18

3,772,479 11/1973 Hilbert ..... 381/18

3,982,071 9/1976 Weiss et al. ..... 381/19

4,281,833 8/1981 Sandler et al. ..... 273/85 G 4,464,781 8/1984 Kaneko et al. ..... 381/18

*Primary Examiner*—Forester W. Isen

*Attorney, Agent, or Firm*—Fisher, Christen & Sabol

[57] ABSTRACT

A stereophonic sound producing apparatus employs four speakers, a background-sound input signal and input-sound signals, to provide an on-the-spot "live action" feeling. The sounds are combined and varied such that a sound such as an artillery shell has a simulated sound and an aurally simulated movement discernible to a human ear. Mixers and attenuators are used, so that a digital "1" or "0" signal serves to operate the on-the-spot "live action" sound effects. A cockpit is provided, together with a video display. A video signal and/or background sound signal is provided by a digitally encoded disk.

7 Claims, 2 Drawing Figures

STEREOPHONIC SOUND PRODUCING APPARATUS FOR A GAME MACHINE

BACKGROUND OF THE INVENTION

This invention relates to a stereophonic sound producing apparatus for a cockpit type game macine, which produces stereophonic sounds from a two-channel source.

Game machines are known having speakers, as for example arcade video machines. Some machines have stand-up operation while others use a cockpit so the player may be seated. However, the known prior art cockpit-type game machines do not completely give a "live action" feeling using four-speaker stereophonic mixed sounds to superimpose a sound (such as an artillery shell) upon background sounds such that movement of the shell if aurally tracked by the human ear to see to follow a path.

SUMMARY OF THE INVENTION

An object of the invention is to utilize the two-channel source to produce stereophonic sounds of on-the-spot "live action" feeling without significantly increasing any manufacturing cost.

The stereophonic sound producing apparatus of the invention is provided with: left-hand and right-hand background sound input terminals which are given sound signals from a first signal source, such as a laser disc player; front and rear game sound input terminals which are given sound signals from a second signal source, such as a computer; left-hand and right-hand control signal input terminals which are given control signals from said second signal source; and first, second, third, and fourth loudspeakers disposed at the forwardly right-hand side, forwardly left side, rearwardly right-hand side, and rearwardly left side with respect to a seat disposed at the center of a game machine body; the loudspeakers connecting the precedent stages thereof to first through fourth power amplifiers and first through fourth mixers in the order, the right-hand background input terminal connecting to the first mixer and also selectively to the third and/or fourth mixer through a first phase shifter, the left-hand background sound input terminal connecting to the second mixer and also selectively to the fourth and/or third mixer through a second phase shifter, a selected one of either front and rear game sound input terminals connecting to the first and second mixers and the oter connecting to the third and fourth mixers through first and second variable gain controllers, and the left-hand and right-hand control signal input terminals connecting to the variable gain controllers respectively, so that logical "1" and "0" signals from the control signal input terminals are adapted to obtain the stereophonic sound.

DETAILED DESCRIPTION OF THE DRAWINGS

Figure 1:
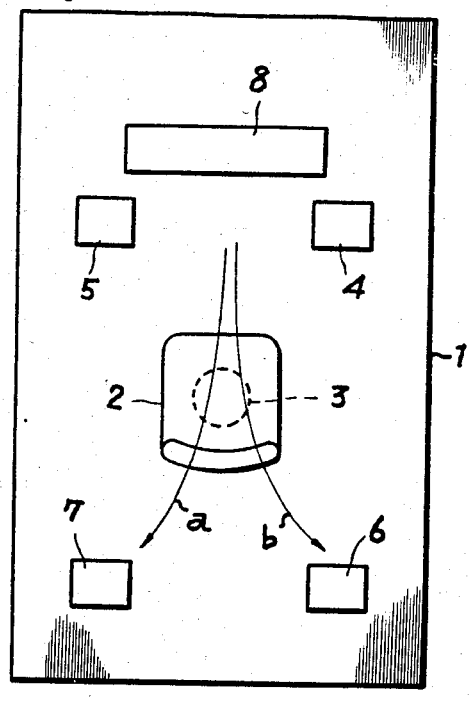
FIG. 1 is a plan view of layout of a preferred embodiment of a game machine of the present invention.

FIG. 1 is a plan view of a layout of a cockpit-type game machine, in which is shown a game machine body 1 and a seat 2 disposed at the center of the body 1, as well as a woofer 3 which is disposed under the seat 2.

First, second, third and fourth loudspeakers 4, 5, 6, and 7, respectively, are disposed at a forward right-hand side, a forward left side, a rearward right-hand side, and a rearward left side, with respect to the seat 2; as well as a Braun tube display unit 8 being disposed in front of seat 2.

Figure 2:
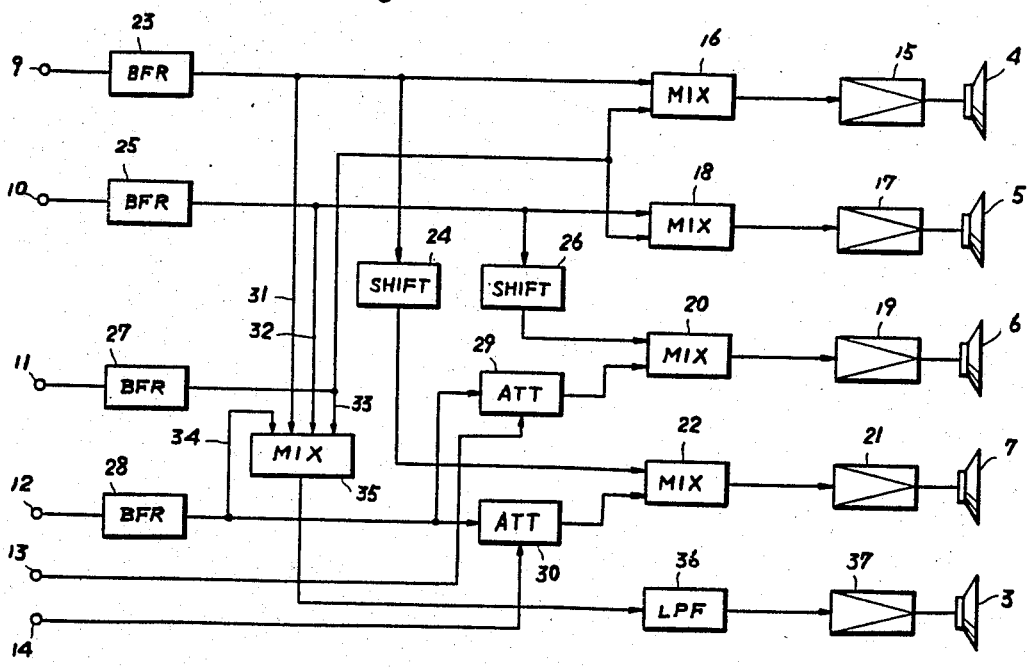
FIG. 2 is a block diagram of the FIG. 1 preferred embodiment.

Next, explanation will be given on construction, in a preferred embodiment, of an electric circuit for the respective loudspeakers 4 through 7 in accordance with FIG. 2.

In the same figure, 9, 10 are background input terminals into which sound signals are fed from a first signal source (not shown), such as a laser disc player, the terminal 9 being used at the right-hand side, and terminal 10 being at the left side.

Game sound input terminals 11, 12 are terminals into which sound signals are fed from a second signal source (not shown) such as a computer, the terminal 11 serving at the front, the terminal 12 being at the rear.

Control signal input terminals 13, 14 are terminals into which control signals are fed from the second signal source, the terminal 13 serving at the right-hand side, the terminal 14 being at the left side.

On the other hand, the first loudspeaker 4 connects at the precedent stage thereof to a first power amplifier 15 and a first mixer 16 in the order, the second loudspeaker 5 connecting similarly to a second power amplifier 17 and a second mixer 18 in the order, the third loudspeaker 6 connecting similarly to a third power amplifier 19 and a third mixer 20 in the order, and the fourth loudspeaker 7 connecting similarly to a fourth power amplifier 21 and a fourth mixer 22 in the order.

The right-hand background sound input terminal 9 connects to the first mixer 16 through a first buffer amplifier 23 and also to the fourth mixer through the buffer amplifier 23 and a first phase shifter 24.

The left-hand background sound input terminal 10 connects to the second mixer 18 through a second buffer amplifier 25 and also to the third mixer 20 through the buffer amplifier 25 and a second phase shifter 26.

The front game sound input terminal 11 connects to the first and second mixers 16, 18 through a third buffer amplifier 27 and the rear game sound input terminal 12 connects to a fourth buffer amplifier 28, so that an output stage thereof connects to the third and fourth mixers 20, 22 separately through attenuators 29, 30 serving as first and second variable gain controllers respectively.

Also, the left-hand and right-hand controlsignal input terminals 13, 14 connect to the first and second attenuators 29, 30 respectively, and the output lines 31, 32, 33 and 34 of buffer amplifiers 23, 25, 27 and 28 connect to the woofer 3 through a fifth mixer 35, a low-pass filter 36 and a fifth power amplifier 37 in the order.

In addition, the buffer amplifiers 23, 25, 27 and 28 as well-known amplify the oscillation output to drive the output lines and also allow the apparatus to stably operate by preventing the oscillation frequency from being affected by the rear stage.

Also, the attenuators 29, 30 serve to weaken signals down to desired intensity (decibel level).

Furthermore, the mixers 16, 18, 20, 22 and 35 serve to properly mix two or more sound signals, or else serve to adjust them in quality.

The operation of the embodiment constructed as above-mentioned will be described.

Now, the sound signals given from the input terminals 9 to 12 function as follows: the signal given from the right-hand background sound input terminal 9 actuates the first loudspeaker 4 at the forwardly right-hand side through the components 23, 16 and 15, and actuates the fourth loudspeaker 7 at the rearwardly left side through the components 23, 24, 22, and 21.

The signal given from the left-hand background sound input terminal 10 actuates the second loudspeaker 5 at the forwardly left side through the components 25, 18 and 17, and also the third loudspeaker 6 through the components 25, 26, 20 and 19.

The signal given from the front game sound input terminal 11 actuates the first and second loudspeakers 4 and 5 at the front through two lines of components 16 and 15 and components 18 and 17.

Furthermore, the signal given from the rear game sound input terminal 12 actuates the third and fourth loudspeakers 6 and 7 at the rear side through two lines of components 29, 20 and 19 and those 30, 22 and 21.

Here, when one control signal input terminal 13 is applied with logical "1" signal from the second signal source, such as a computer, the logical "1" signal controls the attenuator 29 in gain attenuation, whereby the sound from the third loudspeaker 6 at the rearwardly right-hand side becomes smaller with respect to that from the fourth loudspeaker 7 at the rearwardly left side. Hence, a player sitting on the seat 2 and enjoying the game will hear the game sound as if it flows from the front rearwardly leftwardly in a curve designated by a in FIG. 1.

When logical "1" signal is applied to the other control signal input terminal 14, the logical "1" signal similarly controls the attenuator 30 in gain attenuation, whereby the sound from the fourth loudspeaker 7 at the rearwardly left side becomes smaller with respect to that from the third loudspeaker 6. Hence, the player will hear the game sound as if it flows from the front rearwardly rightwardly in a curve, thereby enabling to obtain an on-the-spot "live action" feeling.

In this case, the logical "0" and "1" signals applied to the control signal input terminals 13, 14 are combined with each other to enable the game sound to change in various flows, thereby obtaining various on-the-spot feelings.

On the other hand, a signal in a low compass given from the fifth mixer 35 to the power amplifier 37 through the lowpass filter 36 actuates the woofer 3 below the seat 2, whereby even if the seat has a cushion as usual, the player can hear the sound in the low compass and also is vibrated to be given an on-the-spot "live action" feeling.

Here, the game sounds are dependent on the kinds of games selected, and are various, in which, for example, sounds of a flying missile or rocket, or sounds of shells flying about, are cited. Also, the sound in the low compass will simulate, for example, a blasting sound of a mine.

In addition, in the above-mentioned embodiment, the output of terminal 9 is given to the fourth speaker 7 through the components 23, 24, 22 and 21, and that of terminal 10 to the third speaker 6 through the components 25, 26, 20 and 19. Alternatively, the construction may of course be vice versa.

As above-mentioned in detail, the apparatus of the first invention is provided with the left-hand and right-hand background sound input terminals 10, 9 which are given sound signals from the first signal source, such as the laser disc player, the front and rear game sound input terminals 11, 12 which are given sound signals from the second signal source, such as the computer, the left-hand and right-hand control signal input terminals 14, 13 which are given control signals from the second signal source, and the first, second, third and fourth loudspeakers 4, 5, 6 and 7 disposed at the forwardly right-hand side, forwardly left side, rearwardly right-hand side, and rearwardly left side with respect to the seat 2 disposed at the center of the game machine body 1, so that the loudspeakers 4, 5, 6 and 7 connect at the precedent stages thereof to the first through fourth power amplifier 15, 17, 19 and 21 and the first through fourth mixers 16, 18, 20 and 22, the right-hand background sound input terminal 9 connects to the first mixer 16 and to the third or fourth mixer 20 or 22 through the first phase shifter 24, the left-hand background sound input terminal 10 connects to the second mixer 18 and to the fourth or third mixer 22 or 20 through the second phase shifter 26, the one game sound input terminal 11 connects to the first and second mixers 16, 18, the other input terminal 12 connects to the third and fourth mixer 20, 22 through the first and second variable gain controllers 29, 30 respectively, and the left-hand and right-hand control signal input terminals 14, 13 connect to the variable gain controllers 30, 29, so that the logical "1" and "0" signals at the control signal input terminals 13, 14 can obtain stereophonic sound. Hence, the stereophonic sound can be produced in four channels using the two channel source, changing a flow of sound so that it is continuously variable if desired, and having an on-the-spot "live action" feeling without increasingly significantly any manufacturing cost.

The second invention, besides the construction in the first invention, disposes the woofer 3 below the seat 2 and connects to the background sound and game sound input terminals 9, 10, 11 and 12 through the fifth mixer, low-pass filter 36 and power amplifier 37, whereby, even if the seat has the cushion as usual, the player can hear sound in the low compass and be vibrated and given a better on-the-spot "live action" feeling.

What is claimed is:

1. A stereophonic sound producing apparatus for a game machine, comprising a left-hand and a right-hand background sound input terminals which receive signals from a first signal source; front and rear game sound input terminals receiving signals from a second signal source; left-hand and right-hand control signal input terminal receiving control signals from said second signal source; and first, second, third and fourth loudspeakers disposed at a forwardly right-hand side, a forwardly left side, a rearwardly right-hand side, and a rearwardly left side with respect to a seat disposed generally at a center portion of a game machine body, each loudspeaker being connected at respective precedent stages thereof to first, second, third, and fourth power amplifiers and to first, second, third and fourth mixers, respectively; said right-hand background sound input terminal being connected to said first mixer and to said fourth mixer through a first phase shifter, said left-hand background input terminal being connected to said second mixer and to said third mixer through a second phase shifter; one of said front and said rear game sound input terminals being connected to said first and said second mixers, the other one of front and said rear game sound input being connected to each of said third and said fourth mixers separately through respective first and second variable gain controllers; said left-hand and said right-hand control signal input terminals being connected to respective ones of said first and said second variable gain controllers respectively, such that sterophonic sounds are obtained by logical signals supplied from said left-hand and right-hand control signal input terminals.

2. A stereophonic sound producing apparatus for a game machine, comprising: left-hand and right-hand background input terminals receiving signals from a first signal source; front and rear game sound input terminals receiving sound signals from a second signal source; left-hand and right-hand control signal input terminals receiving control signals from said second signal source; and first, second, third and fourth loudspeakers disposed at a forwardly right-hand side, a forwardly left side, a rearwardly right-hand side and a rearwardly left side with respect to a seat disposed generally at a center portion of a game machine body; said seat having a woofer-range speaker which is connected with each of said background sound and said game sound input terminals through a fifth mixer, a low pass filter, and a power amplifier; each of said loudspeakers being connected at respective precedent stages thereof to first, second, third, and fourth power amplifiers and to first, second, third and fourth mixers, respectively; said right-hand background sound input terminal being connected to said first mixer and also to said fourth mixer through a first phase shifter; said left-hand background input terminal being connected to said second mixer and also to said third mixer through a second phase shifter; one of said front and said rear game sound input terminals being connected to said first and said second mixers, the other one of said front and said rear game sound input terminals being connected to each of said third and said fourth mixer separately through respective first and second variable gain controllers; said left-hand and said right-hand control signal input terminals being connected to respective ones of said first and said second variable gain controllers respectively, such that stereophonic sounds are obtainable by logical signals supplied from said control signal input terminals.

3. A sterephonic sound producing apparatus as claimed in claim 2, wherein said fifth mixer is connected with each of said left-hand and right-hand background sound input terminals and said front and rear game sound input terminals.

4. A stereophonic sound producing apparatus as claimed in claim 1, wherein said first signal source comprises a laser disc player.

5. A stereophonic sound producing apparatus as claimed in claim 2, wherein said first signal source comprises a laser disc player.

6. A stereophonic sound producing apparatus as claimed in claim 1, wherein said second source comprises a computer.

7. A stereophonic sound producing apparatus as claimed in claim 2, wherein said second signal source comprises a computer.

* * * * *